United States Patent [19]

Straub

[11] Patent Number: 4,824,702

[45] Date of Patent: Apr. 25, 1989

[54] TRANSFER ADHESIVE SHEET MATERIAL

[76] Inventor: Dale K. Straub, 2925 Terrace Ave., Alhambra, Calif. 91803

[21] Appl. No.: 872,884

[22] Filed: Jun. 11, 1986

[51] Int. Cl.[4] ..... A45D 31/00

[52] U.S. Cl. ..... 428/15; 132/73; 428/40

[58] Field of Search ..... 132/73; 40/2 R, 1.5, 40/299; 428/15, 40, 41

[56] References Cited

U.S. PATENT DOCUMENTS

| | | | |
|---|---|---|---|
| 2,170,147 | 8/1939 | Lane | 428/43 X |
| 2,411,328 | 11/1946 | Mac Nab | 428/198 X |
| 2,884,126 | 4/1959 | Ulrich | 428/480 X |
| 3,522,136 | 7/1970 | Williams et al. | 428/41 X |
| 3,598,685 | 8/1971 | Lee et al. | 132/73 |
| 3,684,641 | 8/1972 | Murphy | 428/154 |
| 3,898,357 | 8/1975 | Miller et al. | 132/73 X |
| 3,936,567 | 2/1976 | Vesely | 428/40 X |
| 4,008,115 | 2/1977 | Fairbanks et al. | 428/41 X |
| 4,150,183 | 4/1979 | Reed | 428/42 |
| 4,219,596 | 8/1980 | Takemoto et al. | 428/41 |
| 4,511,608 | 4/1985 | Ferraro | 132/73 X |
| 4,526,405 | 7/1985 | Hattemer | 428/42 X |
| 4,536,426 | 8/1985 | Massey | 428/42 |
| 4,600,030 | 7/1986 | Newman | 428/15 X |
| 4,617,214 | 10/1986 | Billarant | 428/40 |

*Primary Examiner*—Henry F. Epstein

*Attorney, Agent, or Firm*—Wilsson, Rabbins, Dalgarn, Berliner, Carson & Wurst

[57] ABSTRACT

A transfer adhesive tab sheet and method for making the same. The sheet includes one or more adhesive areas positioned between a first liner and one or more corresponding top tab liners. The top tab liners have areas that extend beyond the respective adhesive area over the perimeter thereof. The method includes the steps of applying one or more areas of transfer adhesive to the first liner, applying the second liner and die cutting one liner to form the top tab liners having areas extending beyond the corresponding adhesive areas over the perimeters thereof.

13 Claims, 1 Drawing Sheet

FIG. 1
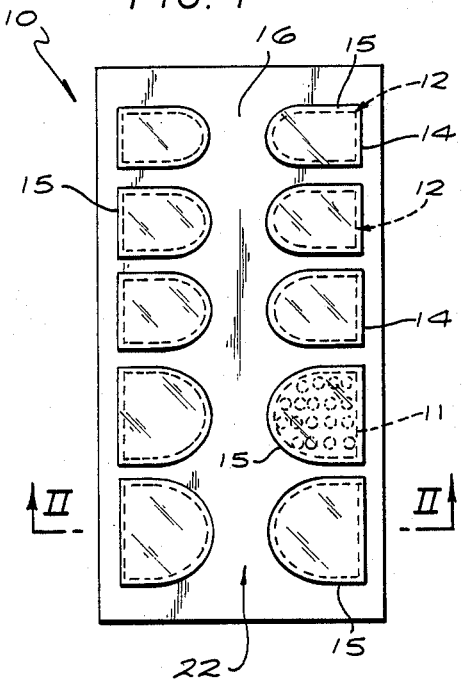
FIG. 4
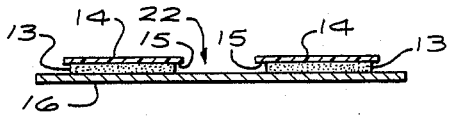
FIG. 2
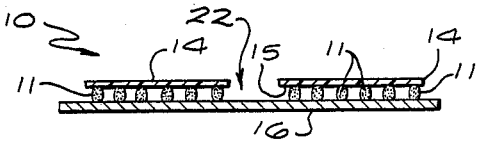
FIG. 8
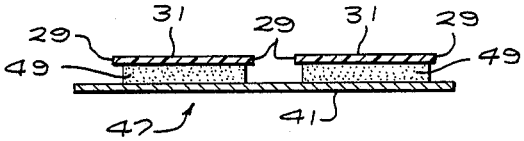
FIG. 3
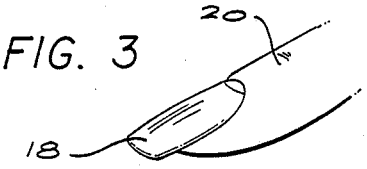
FIG. 5
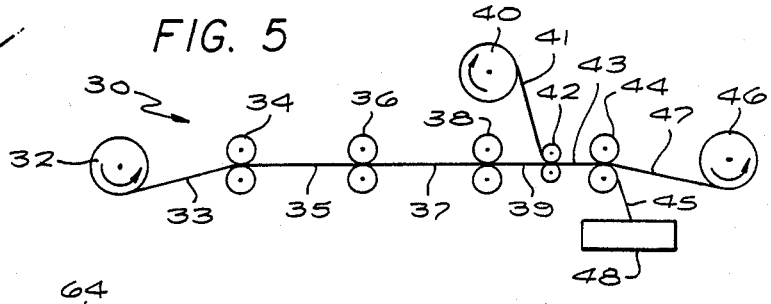
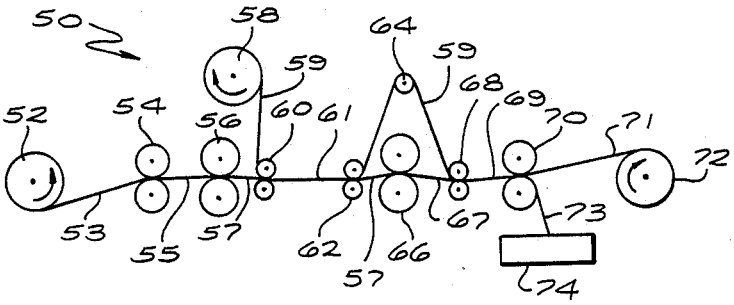
FIG. 6
FIG. 7
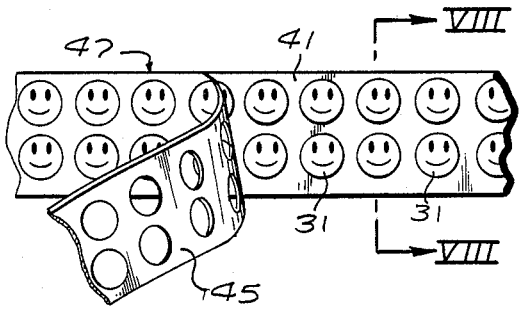

TRANSFER ADHESIVE SHEET MATERIAL

BACKGROUND

The present invention relates generally to adhesive labels and transfer adhesive sheet and more particularly to a method and apparatus for producing sheet of adhesive labels and precut areas of transfer adhesive.

Transfer adhesive tabs are used for applying a predetermined shape of adhesive for the binding of two objects. Generally, the transfer adhesive tabs are fabricated as sheet material that includes an adhesive protected by two liners, each being positioned on either side of the adhesive. For example, transfer adhesive tab sheet is available for applying preformed areas of transfer adhesive to finger nails for securing false plastic finger nails thereto.

The known methods of producing such sheet material of transfer adhesive tabs include the steps of applying an adhesive layer to the entire surface of a first liner material and then laminating a second liner material so as to sandwich the adhesive layer between the liners. The next step is to die cut through one liner material, considered the top liner material, and the transfer adhesive layer without die cutting through the other liner material, considered the bottom liner material, to thereby form the tabs which include the predetermined areas of transfer adhesive and the corresponding remaining top liner material laminated thereto. The waste material left between the tabs, including the unwanted adhesive and unwanted top liner material, is then removed leaving the bottom liner material and the predetermined areas of transfer adhesive covered by top liner material that does not extend beyond such predetermined areas.

The sheet material may be manufactured in small pieces or in a long piece formed into a roll. Roll material is generally manufactured in a continuous process which is typically more economical than making small pieces such as letter or A4 size or other sizes. The roll can be cut into such smaller sizes if desired.

A similar process may be used to produce sheet material of labels. The labels are intended to be adhered to an object. Thus, (in contrast with the transfer adhesive tab arrangement) the adhesive and the material forming the liner (referred to as the substrate for labels) that will form the label and that will be printed on are chosen so that the substrate will not easily peel away from the adhesive.

This process suffers from a number of disadvantages. First, die cutting through the adhesive without die cutting through the bottom liner is a sensitive and precise operation. Variations in the thickness of the adhesive will result in either the adhesive not being complete die cut or the bottom liner being die cut to some extent.

Another disadvantage of this process is the difficulty presented in stripping away the waste material without removing the die cut transfer adhesive tabs. There is a tendency, due to the presence of the adhesive, for the tabs to stick to the die. This tendency is aggravated if, due to variations in the adhesive thickness, the adhesive is not completely cut through.

In the event that, due to variations in the adhesive thickness or otherwise, the bottom liner material is cut by the die, it becomes difficult to separate the adhesive from the cut bottom liner material without destroying the integrity of the adhesive.

Another difficulty arising when the desired adhesive thickness on a particular substrate is only needed for a small job. Substrate is typically purchased precoated. Orders of special precoated adhesive substrate combinations must be bought in minimum quantities or for escalated prices. Some desired adhesive thicknesses may not be available. Typically, the maximum adhesive available on precoated sheets is five thousandths of an inch. The normal thickness is one-half of one thousandth of an inch.

SUMMARY

These disadvantages of prior arrangements have been alleviated to a great extent by the present invention which provides transfer adhesive tab sheet material wherein the top liner material extends beyond the area of the adhesive. According to the method of the present invention, the predetermined adhesive areas are applied to one liner in effectively their final desired shape and relative position. The other liner is then applied to the pattern of adhesive areas. The die cuts are slightly larger than the adhesive areas so that no adhesive is penetrated during the die cut. In this manner, the disadvantages resulting from die cutting through the adhesive are eliminated.

BRIEF DESCRIPTION OF THE DRAWINGS

FIG. 1 is a top view of transfer adhesive tabs for false finger nails according to a preferred embodiment of the present invention.

FIG. 2 is a view taken along section line II—II of FIG. 1.

FIG. 3 is a perspective view of a tip of a finger illustrating a false finger nail secured by the transfer adhesive from the tabs of FIG. 1.

FIG. 4 is a view like FIG. 2 illustrating an alternate embodiment.

FIG. 5 is a schematic illustration of a rotary die press line according to the present invention.

FIG. 6 is a view like FIG. 5 showing an alternate embodiment.

FIG. 7 is a plan view of a label sheet material according to the present invention.

FIG. 8 is a view taken along section line XIII—XIII of FIG. 7.

DETAILED DESCRIPTION

Refer now to FIG. 1 there being shown a sheet of transfer adhesive tabs generally designated by reference numeral 10 in accordance with the present invention. Sheet 10 includes a bottom liner 16 and a number of transfer adhesive areas 12 covered by tab top liners 14. Each tab 14 is slightly larger than its respective transfer adhesive area 12 to form a lip 15 over essentially the entire perimeter thereof. Each tab should be larger than its respective adhesive area to a sufficient extent such that adhesive will not be cut during the die cut operation. The exact extent to which a tab 14 is larger than adhesive area 12, i.e., the width of lip 15, will depend on the manufacturing variances and the positioning of the adhesive area 12 and the die cutting apparatus as well as the thickness of the adhesive 11, any tendency it may have to spread during the die cut operation and other considerations. The top liner from areas 22 between the tabs 14 have been removed from the sheet 10 of FIG. 1.

Refer now to FIG. 2 there being shown a view of the transfer tab sheet taken along section line II—II of FIG. 1. Note that adhesive 11 is applied in a dot pattern and is not continuous throughout the entire extent of adhesive area 12.

Refer now to FIG. 4 there being shown a view like FIG. 2 illustrating an alternate embodiment wherein transfer adhesive 13 is utilized and is in a continuous form through area 12 rather than in a dot pattern as is transfer adhesive 11 of FIG. 2.

Refer now to FIG. 3 there being shown a false finger nail 18 adhered to finger 20 using the transfer adhesive 11 applied using tab 14 from the sheet 10 of FIG. 1.

According to the method of the present invention a top liner sheet and bottom liner sheet are provided, transfer adhesive is applied to one of the liner sheets, the other liner sheet is then laminated to the first liner sheet with the adhesive sandwiched between the liners. The excess liner sheet between adhesive areas is removed by a die cut operation leaving a border or lip of liner sheet around the perimeter of the adhesive area.

Refer now to FIG. 5 wherein is shown a schematic illustration of a rotary die press line, generally referred to by reference numeral 30, according to the present invention. Rotary type die cutting systems are generally available such as from the mark Andy Company or Webtron Company. The rotary die cutting systems are available with a number of stations. Each station performs a separate process, such as printing on the substrate or applying adhesive to the substrate. The presently available rotary type die cutting systems can not handle particularly aggressive or sticky adhesive types. When such adhesives are used the rotary type die cutting system may not be used for applying the adhesive and the adhesive must be applied with a silk screen press or a sheet fed press. This increases the cost of making a particular product because the die cutting must be performed by a separate machine from the adhesive application. Moreover, this process must be done by hand.

A rotary extrusion adhesive application system, such as the Graco/LtI Micro-Print hot melt adhesive applicator, available from Graco, Inc., P. 0. Box 1441, Minneapolis, Minn. 55440 is capable of applying aggressive adhesives to substrate material. As will be described below with reference to FIG. 5, such a rotary extrusion system is combined with a rotary die cutting system according to the present invention to yield a continuous process for producing custom transfer adhesive and label sheet even with aggressive strong.

Material that may be used for substrate include vinyls, lithographic paper that is uncoated or coated on one side, mylar and others. Such substrate materials are available from a variety of sources such as S. D. Warren, Dupont, Crown Zellerbach Paper Mills, Simpson Paper Mills and others. The liner material may be purchased from Technicote Paper Company, Akrosil Liner Company, Schueller Liner Company and others. Adhesives are generally available from H. B. Fuller Adhesive Company, Findley Adhesive and others.

As shown in FIG. 5, substrate 33 supplied from substrate supply roll 32 is directed to first printing station 34, wherein a design representing a message, logo or otherwise is applied to substrate 33. The once printed substrate 35 is then directed to a second printing station 36 wherein a second design which may be in a different color of ink may be applied. The twice printed substrate 37 is then routed to the adhesive station 38 wherein the adhesive is applied. Adhesive station 38 may include a rotary extrusion adhesive applicator for dealing with particularly strong adhesives. The adhesive printed substrate 39 is then combined with liner material 41 from liner supply roll 40 by laminating rollers 42 to form laminate 43. Die cutting station 44 then cuts through the substrate material of laminate 43 cutting around the pattern of adhesive laid down as described hereinabove. Waste material 45 is then discarded into waste box 48 and the finished sheet 47 is co11ected on take-up roller 46.

Refer now to FIG. 7 wherein finished sheet 47 is shown with waste material 45 being stripped away to leave stickers 31 on liner 41.

FIG. 8 shows a cross-sectional view of finish sheet 47. Adhesive 49 extends essentially continuously throughout the adhesive area lying between liner 41 and labels 31 cut from the substrate. Note that lips 29 of labels 31 extend beyond the adhesive 49 and that the die cutting operation of die cutting station 44 did not cut through adhesive 49. Also note that FIG. 8 is similar to FIG. 4 except that in the product of labels 31 as contrasted to the product of transfer adhesive tabs 14, the material of labels 31 and the properties of adhesive 49 are chosen for strong adherence therebetween so that the label will be firmly affixed to a desired object.

Another use of label 31 may be a lint remover wherein material 31 constitutes an article to be adherred and the lint on the clothing constitutes the object to which the lint remover backer material is adherred.

Alternative to the construction of FIG. 8 the adhesive 49 may be laid down in a pattern within the adhesive area corresponding to a label 31 such as illustrated in the embodiment of FIG. 2.

Another alternate embodiment which is described in further detail with reference to FIG. 6 is where the pattern of adhesive forms and constitutes the message or design to be viewed such as through a transparent material such as a glass or plastic window or door.

Referring to FIG. 6, in this embodiment of a rotary die cutting line generally referred to by reference numeral 50 two colors of adhesive maybe applied and the finished product maybe used as a message or design viewed through a transparent surface. Alternatively, two types adhesives may be applied wherein different adhesive properties are desired for different areas under the die cut substrate or the liner. For example, patterns of a high humidity or water resistant adhesive maybe laid down in an intermingled pattern with a low humidity adhesive to provide effective adhesive properties through a wide range of environmental conditions. Other such mixtures are possible, for example, high temperature and low temperature adhesives. If desired more than two types of adhesives may be applied by increasing the number of stations in the application system.

Substrate 53, supplied by substrate supply roll 52, is fed to the printing station 54 where a message or pattern is printed in ink on the substrate. The printed substrate 55 is then fed to a first adhesive application station 56 which may be a rotary extrusion type system. The once adhesive printed substrate 57 is then laminated by laminating rollers 60 onto liner material 59 supplied from liner supply roll 58. The laminate is formed at this point because the routing of the once adhesive printed substrate 57 may not be a straight path into the second adhesive application station 66 and exposure of the adhesive to contamination or mechanical parts is desirably avoided. Laminate 61 is then routed to delamination rollers 62 wherein the liner 59 is taken away from the once adhesive printed 57 and that material is directed to the second adhesive application station 66 where a second adhesive is applied to the substrate. The delaminated liner is routed over idle roller 64 and then relaminated by laminating roller 68 onto the twice adhesive applied substrate 67. This laminate material 69 is then routed to the die cutting station 70 wherein the die cuts are made and waste material 73 is collected by box 74. The finished sheet 71 is then collected on take-up roller 72.

The above description and drawings are only illustrative of preferred embodiments which achieve the objects, features and advantages of the present invention, and it is not intended that the present invention be limited thereto. Any modification of the present invention which comes within the spirit and scope of the following claims is considered part of the present invention.

What is claimed as new and desired to be secured by Letters Patent of the United States is:

1. A transfer adhesive sheet materail comprising:

adhesive means for adhering an article to an object;

first and second liner means for protecting said adhesive means, said liner means being less adhesive than said article or object to said adhesive means;

said adhesive means positioned over a plurality of separated adhesive areas between said first and second liner means; and, each of said first and second liner means having an area extending beyond essentially the entire perimeter of each said adhesive area, said first liner means being a die cut liner including a plurality of die cut liner tabs, each tab covering at least one corresponding adhesive area and being sized to be larger than said adhesive area to extend beyond essentially the entire perimeter thereof, but not to extend to be in contact with adhesive in a non-corresponding adhesive area.

2. A material as in claim 1 wherein said adhesive means extends essentially continuously within at least one of said adhesive areas.

3. A material as in claim 1 wherein said adhesive means extends within a plurality of separated subareas within at least one of said adhesive areas.

4. A material as in claim 1 wherein said articles are false fingernails.

5. A material as in claim 1 wherein said second liner means is elongated for being formed into a roll.

6. A material as in claim 1 wherein said adhesive means adheres more strongly to said first liner means than to said second liner means.

7. A material as in claim 3 wherein said adhesive subareas form a pattern within the corresponding adhesive area.

8. A material as in claim 7 wherein said adhesive means includes one or more colored adhesives.

9. A material as in claim 7 wherein said pattern includes words.

10. A false fingernail system comprising:

one or more false finger nails; and transfer adhesive tab sheet material including first and second liner means for protecting an area of transfer adhesive means positioned therebetween, each of said liner means being less adhesive than said false finger nails or a natural finger nail to said adhesive means and having an area extending beyond essentially the entire perimeter of each said adhesive area said first liner means being a die cut liner including a plurality of die cut liner tabs, each tab covering at least one corresponding adhesive area and being sized to be larger than said adhesive area to extend beyond essentially the entire perimeter thereof, but not to extend to be in contact with adhesive in a non-corresponding adhesive area.

11. A system as in claim 10 including one or more sets of false finger nails and one or more corresponding sets of areas of transfer adhesive sized to fit a set of fingers of one or more hands.

12. A system as in claim 10 wherein one or more of said areas of transfer adhesive each forms an essentially continuous layer.

13. A system as in claim 10 wherein one or more of said areas of transfer adhesive includes a plurality of subareas of said adhesive.

* * * * *